US006131428A

United States Patent [19]

Wildman

[11] Patent Number: 6,131,428

[45] Date of Patent: Oct. 17, 2000

[54] CHANGEABLE COMBINATION LOCK

[75] Inventor: Kelvin H. Wildman, Honeoye Falls, N.Y.

[73] Assignee: John D. Brush & Co., Inc., Rochester, N.Y.

[21] Appl. No.: 09/131,256

[22] Filed: Aug. 7, 1998

Related U.S. Application Data

[60] Provisional application No. 60/055,980, Aug. 18, 1997.

[51] Int. Cl.[7] ..... E05B 37/00

[52] U.S. Cl. ..... 70/301; 70/323; 70/314; 70/329

[58] Field of Search ..... 70/301–303 A, 70/303 R, 323, 314, 326–329, 333 R, 315–318

[56] References Cited

U.S. PATENT DOCUMENTS

| | | | |
|---|---|---|---|
| 142,529 | 9/1873 | Stockwell . | |
| 1,644,650 | 10/1927 | Millice . | |
| 1,887,797 | 11/1932 | Borzin | 70/303 R |
| 2,775,115 | 12/1956 | Bremer . | |
| 2,925,726 | 2/1960 | Miller | 70/303 A |
| 3,801,761 | 4/1974 | Green | 70/302 X |
| 3,991,596 | 11/1976 | Gartner . | |
| 4,123,923 | 11/1978 | Bako . | |
| 4,376,380 | 3/1983 | Burgess . | |
| 4,468,943 | 9/1984 | Beattie . | |
| 4,512,167 | 4/1985 | Remenicky | 70/329 X |
| 4,693,100 | 9/1987 | Wetz, Jr. | 70/323 X |
| 4,708,006 | 11/1987 | Hodgson | 70/323 X |
| 4,722,207 | 2/1988 | Wertz, Jr. | 70/303 A |
| 4,776,190 | 10/1988 | Miller et al. | 70/303 A |
| 5,009,090 | 4/1991 | Beattie . | |
| 5,184,491 | 2/1993 | Schittenhelm | 707/303 A X |
| 5,575,164 | 11/1996 | Ohsawa | 70/302 X |

*Primary Examiner*—Suzanne Dino Barrett
*Attorney, Agent, or Firm*—Eugene Stephens & Associates

[57] ABSTRACT

A combination of the inventive combination lock can be easily and conveniently changed by the user. A clutch selectively disengages the drive tumbler from the lock spindle. With the drive tumbler disengaged and the tumblers in an aligned position, the user rotates the lock knob by a desired increment, thereby changing all of the numbers by the increment. In one embodiment, the clutch is operated by a cup mounted around the drive cam and engaging the drive tumbler, a spring biasing the drive tumbler against the cup and the drive cam, and the cup carrying a button that, when pressed, moves the drive tumbler out of engagement with the drive cam. In another embodiment, the clutch is operated by a thumb screw projecting through a rear panel of the combination lock that moves an upper part of the drive cam out of engagement with a lower part of the drive cam, allowing relative rotation of the lock dial and the drive tumbler.

39 Claims, 6 Drawing Sheets

CHANGEABLE COMBINATION LOCK

This application claims the benefit of U.S. Provisional Application Ser. No. 60/055,980, filed on Aug. 18, 1997, which provisional application is incorporated by reference herein.

TECHNICAL FIELD

The invention relates to combination locks. More particularly, the invention relates to combination locks that accommodate combination changes by lock users.

BACKGROUND

Combination locks are quite common, and all mechanical ones operate in the same basic fashion. A graduated dial, typically scaled from 1 to 100, rotates a spindle that in turn rotates a drive cam. A bushing supports a series of tumblers, one of which is a drive tumbler connected to the drive cam. The drive cam drives the drive tumbler so that, when a user selects a series of combination numbers with the dial, the driven tumblers are aligned to allow operation of a door handle or lock hasp or the like. In door locks, each tumbler has a gate notch in its periphery situated such that when the notches of all of the tumblers are aligned, a stop on a door handle can travel, allowing operation of the door handle. Most combination locks have only one operative combination that is not easily changed. As a result, if the combination is compromised, a new lock with a different combination would have to be purchased, or the lock would have to be disassembled to change the combination.

In response to a desire for more flexibility and security in combination locks, changeable combination locks have been developed. Most changeable combination locks have some arrangement allowing realignment of the drive system and the tumbler gate notches to alter the combination. For example, one prior art changeable combination lock uses two-part tumblers. Inner tumblers carry teeth on their peripheries that engage teeth on the inner peripheries of outer tumblers. The outer tumblers also carry gate notches on their outer peripheries that allow use of a door handle when aligned. The inner tumblers can be disengaged from the outer tumblers to allow relative rotation for resetting the combination. To change the combination, a user throws the lock bolt out and then inserts a wire into the lock to allow relative movement of the inner and outer tumblers. The lock spindle is then pressed inward to disengage the inner tumblers from the outer tumblers, at which point the combination can be changed. This arrangement includes many steps and parts that increase the complexity of the lock. Also, the requirement of extra tools, such as a wire, to change the combination is inconvenient to the user.

Another prior art changeable combination lock includes a wave or disc spring mounted between an inner wall of a safe door and the immediately adjacent tumbler. The spring biases the tumblers against the drive cam. To change the combination of the lock, the user first removes the back panel of the lock, dials the combination to align the notches, and then holds the door handle in place to hold the notches in alignment. While holding the handle, the user pushes against the drive tumbler to disengage the drive tumbler from the drive cam. Still holding the handle and pushing against the drive tumbler, the user rotates the dial of the lock by a desired increment so that the drive cam engages the drive tumbler at a new point, thus changing the alignment point of all the tumblers by the increment the dial has been rotated. The handle and drive tumbler can then be released, and the lock can be used with the new combination. This lock is easier to use, but requires the user to do too many things at once and does not provide an easy way to disengage the drive cam and drive tumbler.

In view of the prior art, there is a need for a changeable combination lock that is simple in its construction and easy to use. The lock should allow the user to perform relatively few simple steps to change the combination of the lock.

SUMMARY OF THE INVENTION

My new changeable combination lock uses a clutch between the lock spindle and the drive tumbler for easy disengagement. An actuator of the clutch extends into and can protrude from the rear panel of the door or lock for easy access and operation of the clutch by a user from outside the door and without additional tools. The clutch severs the drive connection between the spindle and the drive tumbler so that the user can rotate the knob and spindle relative to the drive tumbler to change the combination. Because the clutch actuator is accessed through the rear panel of the door, the user does not need to remove the panel to change the combination.

More particularly, a first embodiment of my new lock can use a spring-biased combination changer. In this embodiment, the user opens the safe, leaving the handle in an open position to hold the tumbler notches in alignment. The user then presses a button in or protruding from the inside of the door and rotates the combination lock dial by a desired amount. After the user releases the button, the safe can be used with the new combination. This embodiment of my lock is advantageous over the prior art locks because the user need only press a button to disengage the drive cam from the driver rather than removing the back panel of the safe door and pressing on the drive tumbler itself. This embodiment of my lock is also an improvement over locks using multi-part tumblers because my tumblers are very simple.

Alternatively, my invention includes a thumbscrew that holds the drive cam in a disengaged state. Thus, to change the combination of my new lock, the user dials the combination, holds the door handle down, disengages the clutch with the thumbscrew, rotates the dial by a desired amount, reengages the clutch, and can then operate the lock with the new combination. This is a marked improvement over the prior art locks that require the user to remove the rear panel of the door and then hold a spring-biased drive tumbler in a state of disengagement while holding the door handle down and rotating the lock dial. Also, as with the first described embodiment, my lock is an improvement over locks using multi-part tumblers because my tumblers are very simple.

While my new lock can be used in any suitable device, it is intended for use in safe doors. My lock is particularly suited for use in insulated steel shell safes.

DETAILED DESCRIPTION OF THE INVENTION

Figure 1:
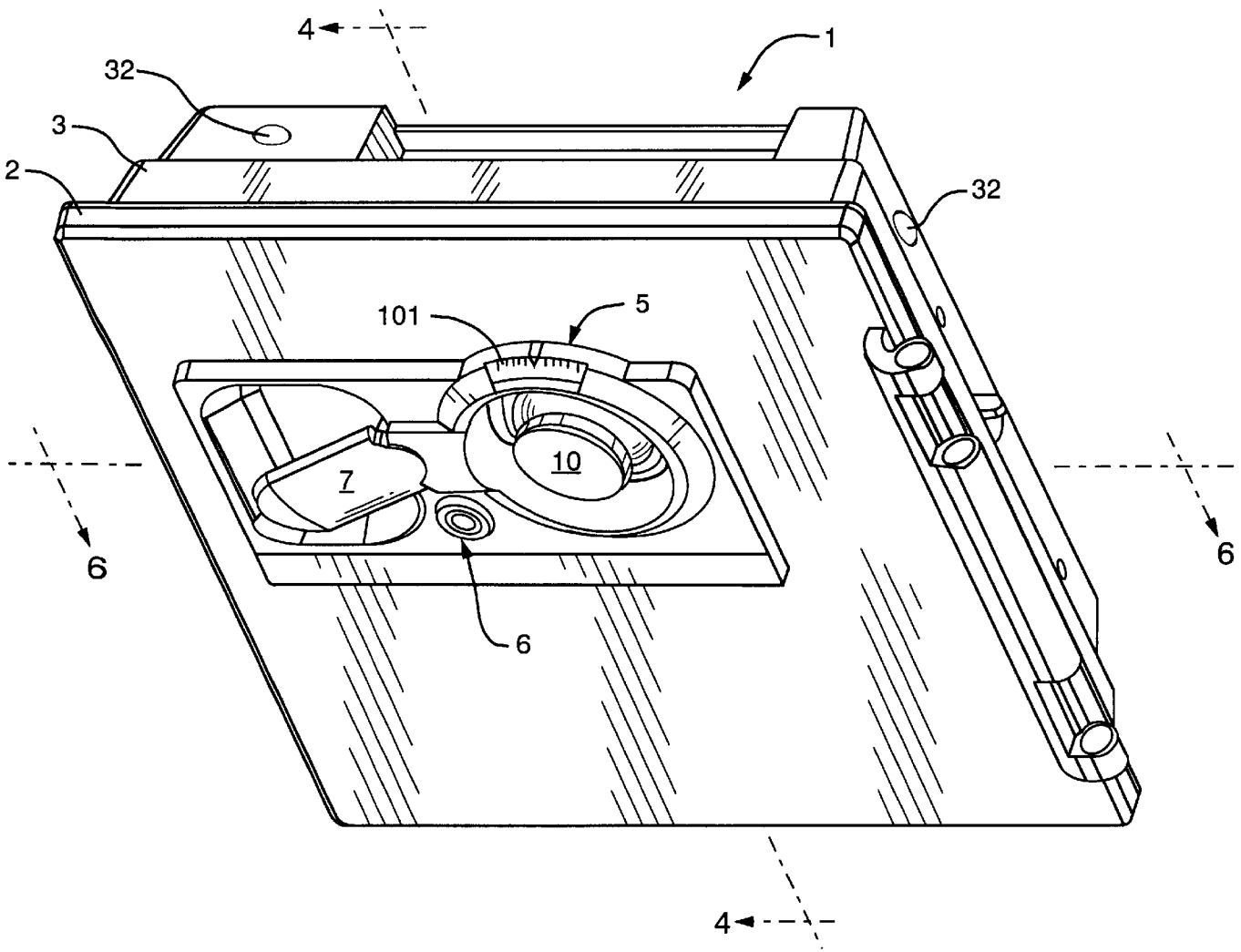
FIG. 1 is a front perspective view of a safe door including the changeable combination lock of the invention.
Figure 2:
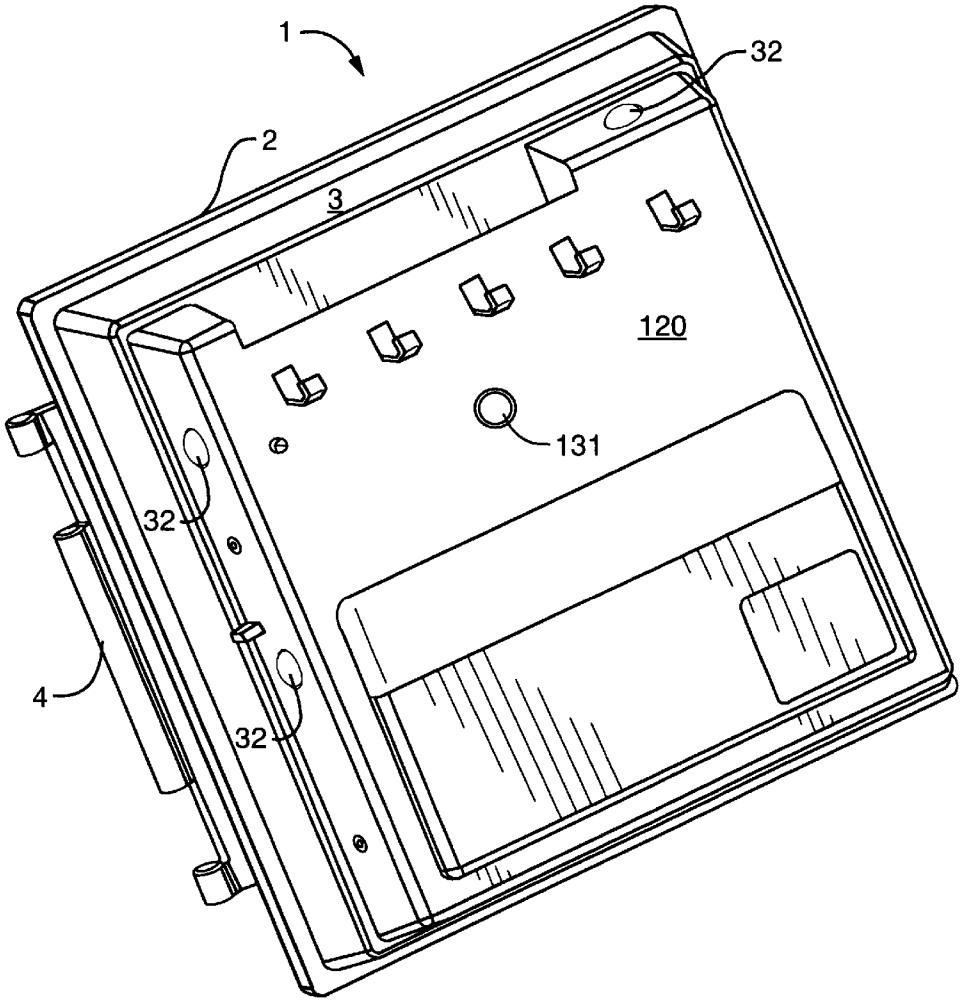
FIG. 2 is a rear perspective view of the safe door of FIG. 1.
Figure 3:
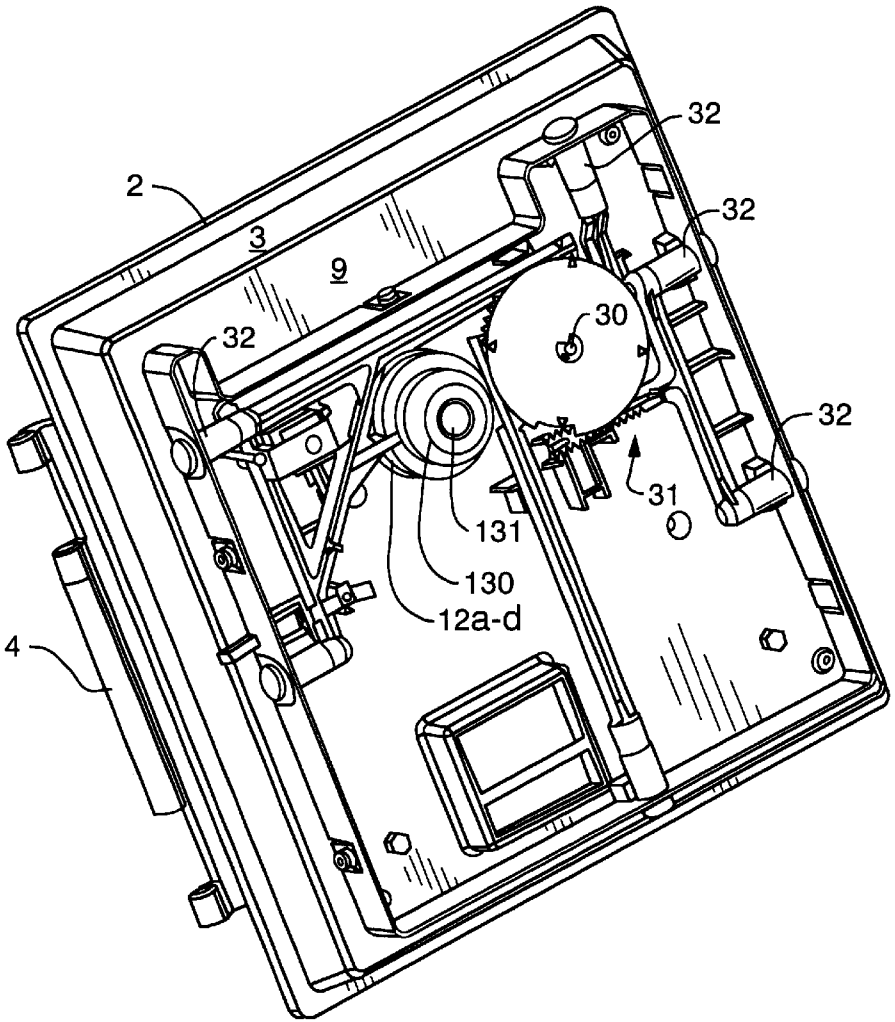
FIG. 3 is a rear perspective view of the safe door of FIG. 1 with the rear panel removed.

As seen in FIGS. 1–3, a door 1 for a steel shell safe (not shown) includes a front door plate 2, a jamb 3 attached to the back of door plate 2, and a hinge 4. A combination lock 5, a key-operated lock 6, and a handle 7 can be mounted on the door 1. Insulative material 8 fills the space between the front door plate 2 and the jamb 3. The preferred insulation 8 is concrete heavily laden with water.

Figure 4:
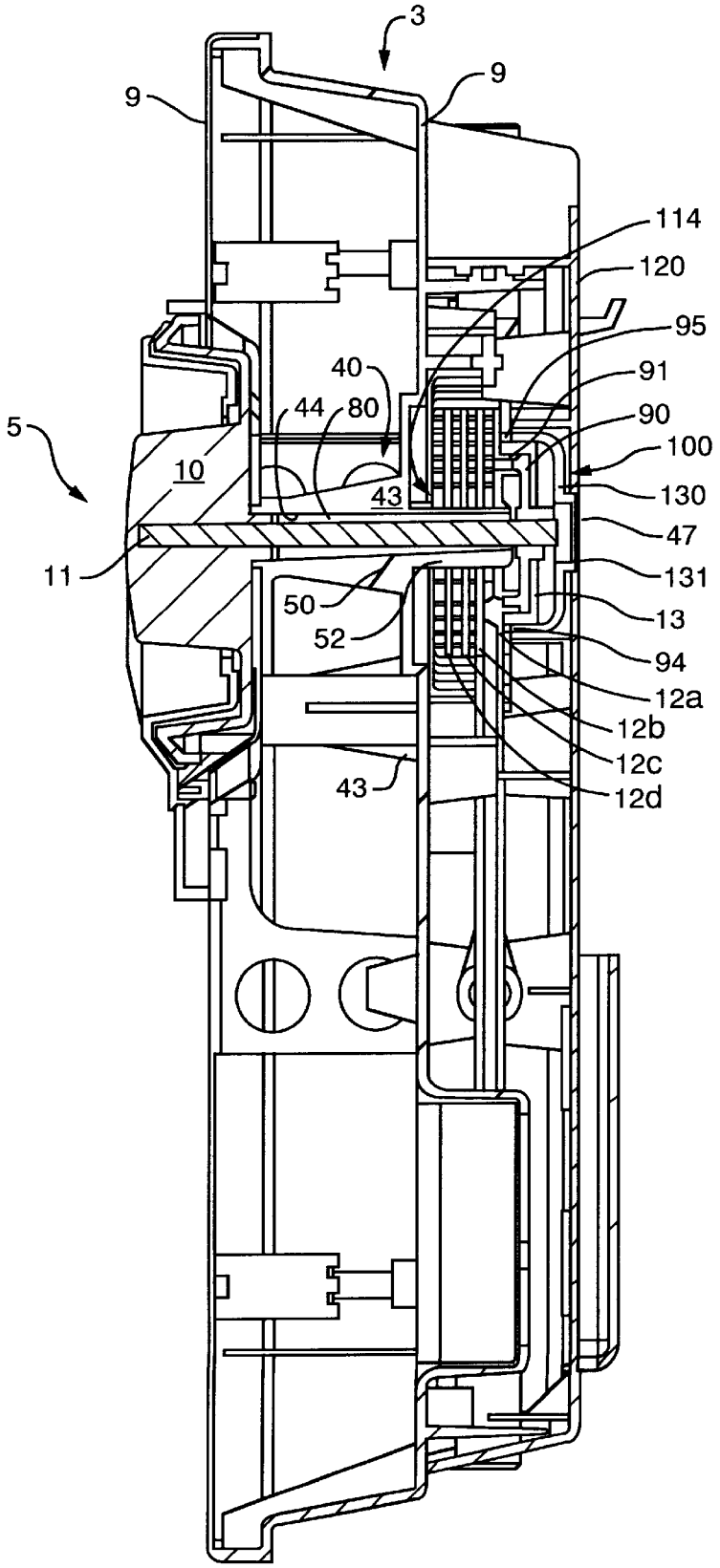
FIG. 4 is a cross section of the safe door of FIG. 1 taken along line 4—4 where the door includes a first embodiment of the lock of the invention.
Figure 5:
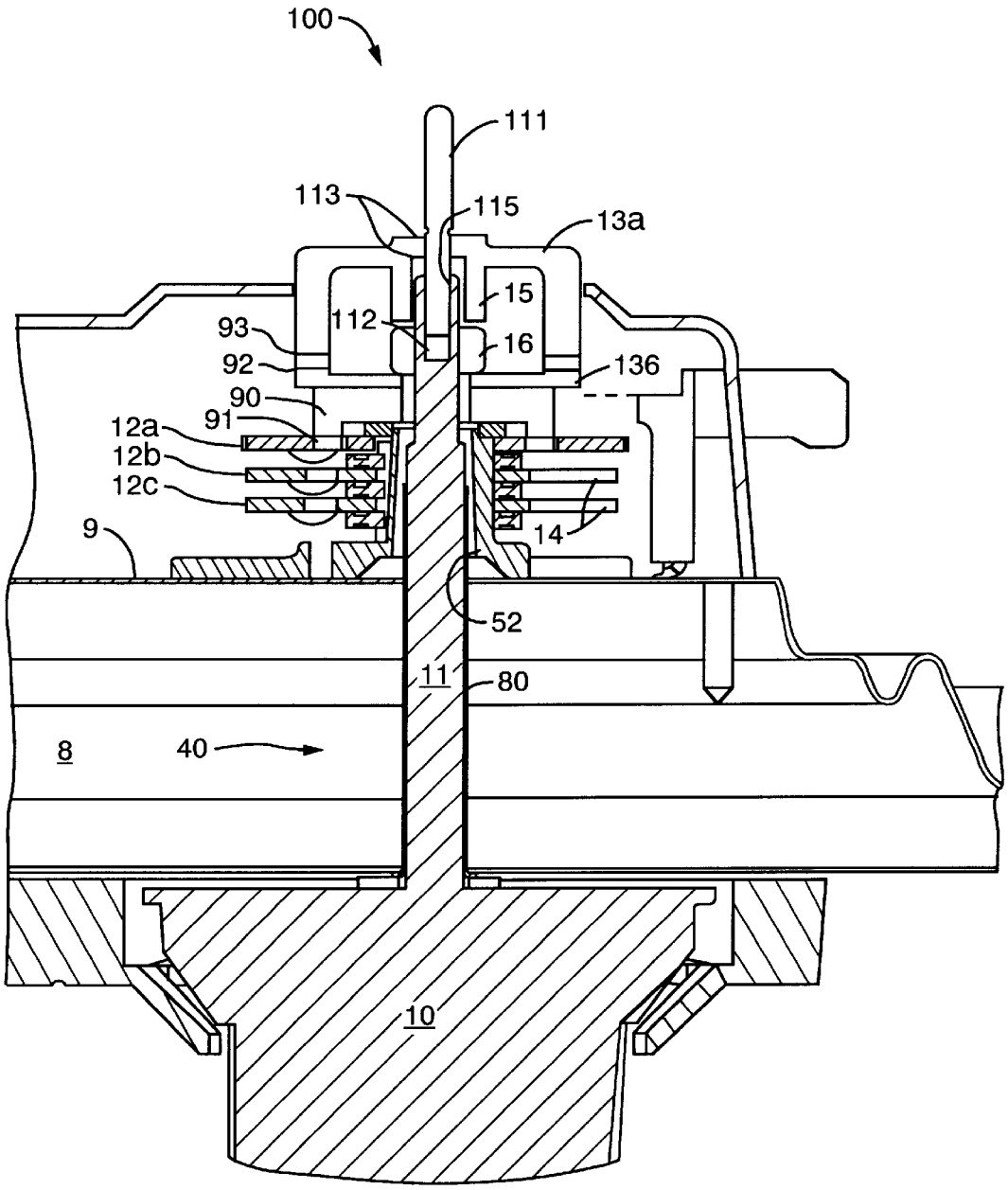
FIG. 5 is a detail of a cross section of the safe door of FIG. 1 taken along line 4—4 where the door includes a second embodiment of the lock of the invention.

As is known in the art, combination lock 5 includes a rotatable knob 10 mounted on the exterior of the door 1. With particular reference to FIGS. 4 and 5, the knob 10 is preferably insert molded onto a forward end of a spindle 11 that extends through the door 1. The inner or rearward region of the spindle 11 is in turn connected to a series of tumbler discs 12 via a driver 13. The tumbler discs 12 are rotatably mounted coaxially with the spindle 11 on the back of the door 1. The driver 13 retains, engages, and drives the tumbler discs 12 about the combination lock spindle 11 so that they can be operated to selectively lock and unlock the safe. The tumblers 12 carry gate notches 14 in their peripheries that are aligned when the combination is dialed.

Figure 6:
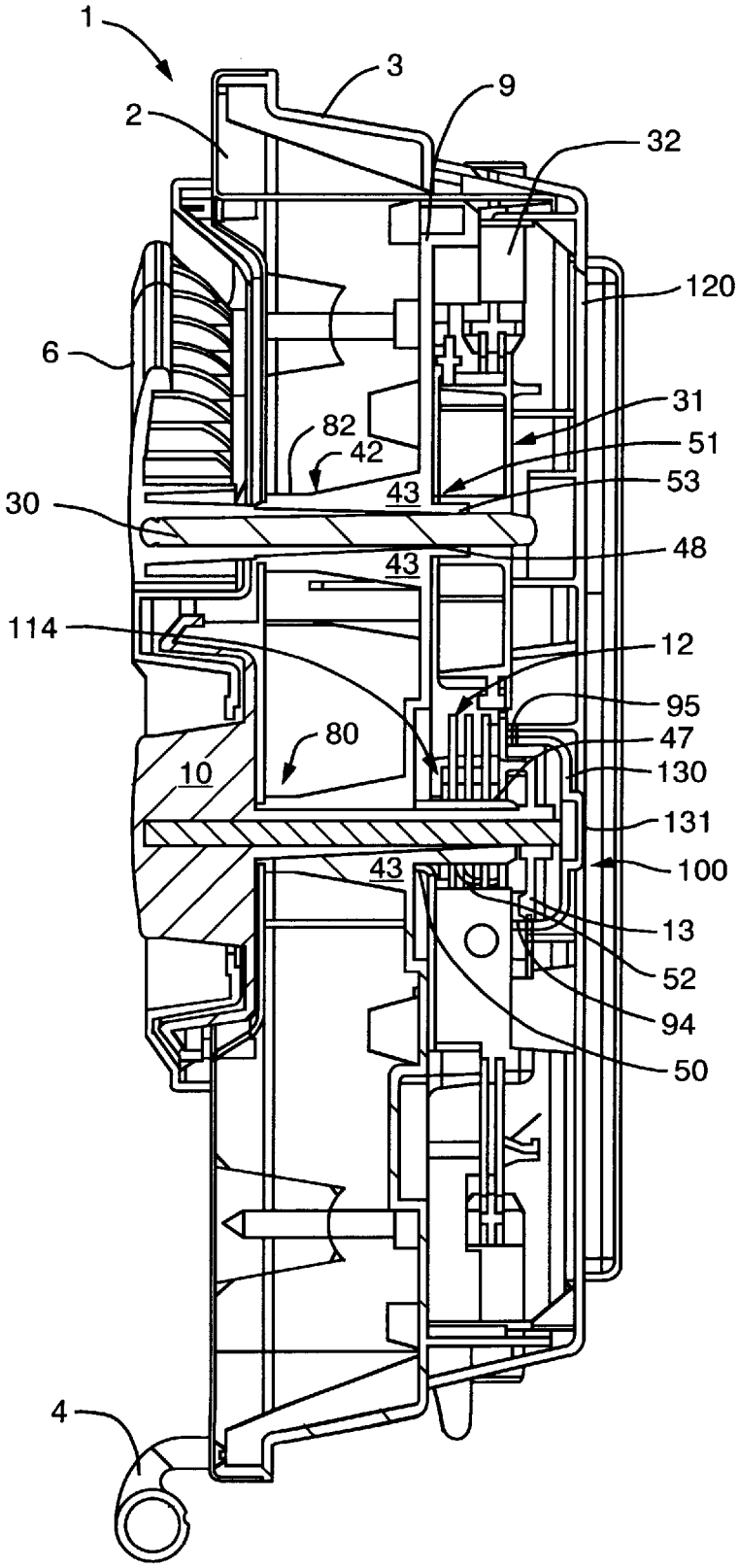
FIG. 6 is a cross section of the safe door of FIG. 1 taken along line 6—6 showing the handle and its associated components in the safe door.

The handle 7, as shown in FIG. 6, is attached to a spindle 30 that operates a live bolt system 31 mounted on the interior surface of the door 1. When the gate notches 14 are aligned and the handle 7 is rotated, the handle spindle 30 also rotates causing the live bolts 32 of the live bolt system to move into or out of a locked position.

The combination lock spindle 11 and handle spindle 30 are each supported by respective bushings 40, 42 in pass-through tube portions 80, 82 that pass from the back of front door plate 2 to the jamb 3. The tube portions 80, 82 preferably have supporting ribs 43 arranged around their outer surfaces and extending into the insulation 8 for extra support. The inner surface 44 of a forward region of the combination lock bushing 40 provides a running fit for the knob 10.

Inner end or rearward portions 50, 51 of the bushings 40, 42, respectively, extend from a forward region of the door 1 to a rearward region of the door 1. The rearward portions 50, 51 preferably extend beyond the rear wall 9 of the jamb 3 to form stub or sleeve portions 52, 53. The outer surfaces 47, 48 of stubs 52, 53 are preferably substantially cylindrical and support components of the combination lock 5 and live bolt system 31.

Stub portion 52 rotatably supports a drive tumbler 12*a* and additional driven tumblers 12*b*, 12*c*, 12*d* on its outer surface. The drive cam 13 carries thereon a number of teeth 90 that engage corresponding teeth 91 provided on the drive tumbler 12*a* such that the drive cam 13 rotates the drive tumbler 12*a*. The mutually engaging teeth 90, 91 can be of any suitable form, but are preferably saw teeth or pegs with corresponding holes. A disengagement mechanism or clutch 100 is interposed in the drive train such that it can selectively disengage the drive tumbler 12*a* from the drive provided by the combination lock spindle 11.

In a second embodiment of the invention, the drive cam 13 is mounted on the end of the spindle 11 for conjoint rotation therewith. The drive tumbler 12*a* is longitudinally slidable and is preferably biased against the drive cam 13 by a spring 114, such as a conical spring. The disengagement mechanism 100 is a cup 130 that preferably sits over and has a larger diameter than the drive cam 13. The cup 130 engages the drive tumbler 12*a* with teeth 94 that mesh with corresponding teeth 95 on the drive tumbler 12*a*. Thus, the teeth 94, 95 are mutually engaging teeth of the cup 130 and the drive tumbler 12*a*. In the preferred form of this embodiment, the cup 130 and the drive tumbler 12*a* are always in a state of engagement and rotate conjointly. The cup carries a button 131 that extends into the rear panel 120, preferably with its rearwardmost surface flush with the rear surface of the rear panel 120 for easy access. The button 131 can also be designed to protrude beyond the rear panel 120 of the lock, allowing easier access to the button 131 but increasing the risk that the button 131 will be depressed accidentally. When depressed, the button transmits force to the cup 130 which transmits the force to the drive tumbler 12*a*. Application of enough force to overcome the bias on the drive tumbler 12*a* causes the drive tumbler 12*a* to disengage the drive cam 13. When the drive tumbler 12*a* and the drive cam 13 are disengaged, the drive cam 13 can rotate freely with respect to the drive tumbler 12*a* and the cup 130.

To change the combination, the user dials in the combination with the lock knob 10 and opens the safe with the handle 7. Leaving the handle 7 down to hold the drive and driven tumblers 12 in place, the user presses the button 131 to disengage the drive tumbler 12*a* from the drive cam 13 and then rotates the lock knob 10 by a desired increment as indicated on the scale 101. The drive cam 13 rotates relative to the drive tumbler 12*a* so that the alignment position of the tumbler gate notches corresponds to the old combination plus the increment dialed by the user. The user then releases the button 131 to reengage the drive tumbler 12*a* and drive cam 13 and can then operate the safe with the new combination. The entire process is done without using any tools and without removing the rear panel 120 of the combination lock 5.

The number of teeth on the drive cam 13 need not be the same as the number of teeth on the drive tumbler 12*a*. One of these parts should carry a number of teeth that is a whole number factor of the maximum number of the dial scale 101. In other words, if the scale 101 has numbers from 1–100, the number of teeth on one of the drive tumbler 12*a* or the drive cam 13 should be a factor of 100. The teeth 90, 91, 94, 95 of all parts of this embodiment can be of any suitable type, but are preferably pegs that meet corresponding holes.

In a second embodiment of the invention, the disengagement mechanism 100 is the drive cam 13, which comprises an upper drive cam 13*a* and a lower drive cam 13*b*. A sleeve 15 on the upper drive cam 13*a* engages the outer surface of the interior end of the combination lock spindle 11 so that the upper drive cam 13*a* rotates with the spindle 11. Preferably, the outer surface of the spindle 11 and the inner surface of the sleeve 15 have square cross sections to better ensure conjoint rotation of these parts.

The lower drive cam 13*b* carries the teeth 90 that engage and drive the drive tumbler 12*a* via corresponding teeth 91 on the drive tumbler 12*a*. Thus, the teeth 90 and the teeth 91 are mutually engaging teeth of the lower drive cam 13*b* and the drive tumbler 12*a*. The lower drive cam 13*b* also carries a set of teeth 92 engaging corresponding teeth 93 on a lower portion of the upper drive cam 13*a*. Thus, the teeth 92 and the teeth 93 are mutually engaging teeth of the upper and lower drive cams 13*a*, 13*b*. A bearing or bushing 16 permits relative rotation between the lower drive cam 13*b* and the lock spindle 11, though the lower drive cam 13*b* can simply slide against the lock spindle 11 if a bearing or bushing 16 is not used.

Upper drive cam 13*a* carries in its center a coaxial adjusting screw 111, preferably a thumb screw that can be adjusted without tools. One end of the screw 111 is mounted in a threaded bore 112 in the interior end of the spindle 11, the other end of the screw extending into and/or protruding from the rear panel 120 of the lock 5 or the door 1. The spindle end of the screw 111 carries threads 115 that mesh with the threads of the spindle bore 112, causing relative axial movement between the screw 111 and the spindle 11 when the screw 111 is rotated relative to the spindle 11. Shoulders or snap rings 113 on the screw on either side of the upper drive cam 13*a* prevent longitudinal movement of the screw 111 relative to the upper drive cam 13*a*.

The drive cams 13*a*, 13*b* and the thumb screw 111 effectively form the clutch 100 in the knob/drive tumbler drive train, with the screw 111 acting as an actuator for the clutch. Unscrewing the screw 111 moves the upper drive cam 13*a* out of engagement with the lower drive cam 13*b*, permitting relative rotation between the spindle 11/upper drive cam 13*a* and the lower drive cam 13*b*/drive tumbler 12*a*.

In operation of the second embodiment, the user first dials the combination of the lock 5 using the knob 10, then operates the handle 7 to open the door 1. Leaving the handle 7 down, the user rotates the screw 111 to disengage the upper cam 13*a* from the lower cam 13*b*. The user then rotates the lock knob 10 by a desired increment to change all of the numbers of the combination by the increment as shown on the scale 101 of the knob 10. The user then screws the upper cam 13*a* back into engagement with the lower cam 13*b* and operates the safe with the new combination. The entire process requires no tools and can be done without removing the rear panel 120 of the combination lock 5 or door 1.

The number and size of the increments available to the user is fixed upon manufacture, but can be varied in the design of the drive cam assembly by changing the number of teeth 92, 93 on the upper and lower drive cams 13*a*, 13*b*. Preferably, the size of the increments is a whole number factor of the scale 101 of the safe dial. For example, if the scale were 1–100, 20 teeth would yield increments of 5. The number of teeth 92, 93 on the upper and lower drive cams 13*a*, 13*b* does not need to be the same. In such a design, the number of teeth on the drive cam with more teeth determines the increment size. The teeth 90, 91, 92, 93 of all parts of this embodiment can be of any suitable type, but are preferably saw teeth or pegs that fit in corresponding holes.

Parts list

1 Door
2 Front door plate
3 Jamb
4 Hinge
5 Combination lock
6 Key lock (key-operated day lock)
7 Handle
8 Insulative material
9 Rear wall of jamb
10 Knob or dial of combination lock
11 Lock spindle (combination lock spindle)
12 Tumblers (tumbler discs)
12*a* Drive tumbler
12*b–d* Driven tumblers
13 Driver (tumbler driver) or drive cam
13*a* Upper drive cam
13*b* Lower drive cam
14 Gate notch
15 Drive cam sleeve
16 Bearing or bushing of lower drive cam
30 Handle spindle
31 Live bolt system
32 Live bolts
40 Combination lock bushing
42 Handle bushing
43 Ribs
44 Inner surface of combination lock bushing
47 Outer surface of combination lock bushing
48 Outer surface of handle bushing
50 Inner end portion of combination lock bushing
51 Inner end portion of handle bushing
52 Stub or sleeve portion of combination lock bushing
53 Stub or sleeve portion of handle bushing
80 Tube portion of combination lock bushing
82 Tube portion of handle bushing
90 Teeth of drive cam engaging drive tumbler
91 Teeth on drive tumbler engaging drive cam
92 Teeth of lower drive cam engaging upper drive cam
93 Teeth of upper drive cam engaging lower drive cam
94 Cup teeth engaging drive tumbler
95 Drive tumbler teeth engaging cup
100 Disengagement mechanism or clutch
101 Scale of lock knob or dial
111 Screw of clutch in upper drive cam
112 Threaded bore hole in combination lock spindle
113 Shoulders or snap rings on screw
114 Spring biasing drive tumbler
115 Clutch screw threads
120 Rear panel of combination lock or door
130 Cup over drive cam and engaging drive tumbler
131 Button on clutch

I claim:

1. A changeable combination lock for a safe door comprising:

a. a drive cam carrying teeth selectively engaging corresponding teeth on a drive tumbler in response to the operation of an actuator extending into a rear panel of the door, the drive tumbler being mounted on a rearward region of a lock spindle extending through a lock bushing mounted in the door;

b. a clutch controlling the selective engagement in response to the actuator, an axially slidable portion of the clutch carrying teeth that engage corresponding teeth on one of the drive cam and the drive tumbler, disengagement of the clutch allowing relative rotation of the drive cam and drive tumbler so that the combination of the lock can be changed;

c. a lock knob fixed on a forward end of the lock spindle, the lock spindle extending from a forward region of the door to a rearward region of the door; and d. a driven tumbler mounted on a rearward region of the lock bushing and engaging the drive tumbler, the drive and driven tumblers each including a gate notch arranged such that the gate notches are aligned when a predetermined combination is dialed using the lock knob, rotation of the knob after alignment of the gate notches and disengagement of the clutch altering the combination of the lock.

2. The changeable combination lock of claim 1 further including a rearward port ion of the lock and wherein:

a. the axially slidable portion of the clutch is a cup that carries the actuator in the form of a button extending from a region forward of the rear panel into the rear panel;

b. the drive cam is fixed on the end of the spindle;

c. the teeth on the drive tumbler comprise a first set of teeth that engage the teeth on the cup and a second set of teeth that engage the teeth of the drive cam so that the drive cam can rotate the drive tumbler;

d. the drive tumbler is axially slidable and is forced against the drive cam by a biasing device; and e. depression of the button forces the drive tumbler out of engagement with the drive cam against the force of the biasing device such that the drive cam can be rotated relative to the drive tumbler by operation of the lock knob, thereby altering the combination of the lock.

3. The changeable combination lock of claim 2 wherein one set of teeth comprises pegs and a corresponding set of teeth comprises holes adapted to receive the pegs.

4. The changeable combination lock of claim 2 wherein one set of teeth comprises saw teeth.

5. The changeable combination lock of claim 1 wherein:

a. the drive cam comprises an upper drive cam and a lower drive cam;

b. the upper drive cam bears teeth, is the axially slidable portion of the clutch, is mounted on a rearward end of the lock spindle for conjoint rotation therewith, and carries the actuator in the form of a screw that threadedly engages a rearward end of the lock spindle such that rotation of the screw relative to the lock spindle causes axial motion of the screw and the upper drive cam;

c. the lower drive cam is mounted on the lock spindle forwardly of the upper drive cam such that it can rotate relative to the lock spindle, first and second sets of teeth being arranged on rearward and forward surfaces of the lower drive cam, respectively;

d. the teeth on the upper drive cam selectively engage the first set of teeth on the lower drive cam; and e. operation of the screw selectively moves the teeth of the upper drive cam out of engagement with the first set of teeth on the lower drive cam such that the upper drive cam can be rotated relative to the lower drive cam by operation of the lock knob, thereby altering the combination of the lock.

6. The changeable combination lock of claim 5 wherein the teeth of one part are pegs and the teeth of another part are holes that receive the pegs.

7. The changeable combination lock of claim 5 wherein mutually engaging teeth of two parts are saw teeth.

8. The changeable combination lock of claim 1 wherein the actuator protrudes from the rear panel.

9. The changeable combination lock of claim 1 wherein the number of teeth on one of the drive cam and the drive tumbler is a whole number factor of a maximum number in a scale on the lock knob such that the combination of the lock can be changed in increments equal to the maximum number divided by the number of teeth.

10. A changeable combination lock comprising:

a. a clutch engaging one of a drive cam and a drive tumbler, the drive cam selectively driving the drive tumbler in accordance with a position of the clutch, an actuator of the clutch extending rearwardly into a rear panel mounted rearwardly of the tumbler and the clutch;

b. a spindle, about which the drive cam is mounted for rotation therewith, and about which the drive tumbler is mounted for relative rotation thereto; and c. a knob fixed on a forward end of the spindle, whereby selective alteration of a combination of the lock is achieved by rotation of the knob by a desired increment after disengaging the clutch to allow relative rotation of the drive cam and drive tumbler.

11. The changeable combination lock of claim 10 wherein:

a. the clutch is a cup mounted around the drive cam and engaging the drive tumbler;

b. the actuator is a button mounted on the cup;

c. a biasing device forces the drive tumbler into engagement with the cup and the drive cam; and d. the button is arranged such that force applied to the button axially slides the cup and the drive tumbler, thereby disengaging and allowing relative rotation of the drive cam and drive tumbler so that the combination can be altered.

12. The changeable combination lock of claim 11 wherein the drive cam and the drive tumbler carry mutually engaging teeth.

13. The changeable combination lock of claim 12 wherein one of the drive cam and drive tumbler has more teeth than the other of the drive cam and drive tumbler.

14. The changeable combination lock of claim 13 wherein the number of teeth on the one of the drive cam and the drive tumbler with more teeth is a whole number factor of a maximum number in a scale on the knob.

15. The changeable combination lock of claim 11 wherein the biasing device is a spring.

16. The changeable combination lock of claim 15 wherein the spring is a conical spring.

17. The changeable combination lock of claim 10 wherein:

a. the drive cam comprises an upper drive cam that rotates with the spindle and a lower drive cam that can rotate freely about the spindle;

b. the clutch is the upper drive cam; and c. the clutch actuator is a screw carried by the upper drive cam in fixed axial relation thereto, the screw threadedly engaging a threaded bore in a rearward region of the spindle such that unscrewing the screw moves the upper drive cam out of engagement with the lower drive cam, thereby allowing relative rotation between the upper drive cam and the drive tumbler for alteration of the combination.

18. The changeable combination lock of claim 17 wherein the upper and lower drive cams carry mutually engaging teeth.

19. The changeable combination lock of claim 18 wherein one of the drive cams has more teeth than the other.

20. The changeable combination lock of claim 19 wherein the number of teeth on the drive cam with more teeth is a whole number factor of a maximum number in a scale on the knob.

21. A changeable combination lock comprising a lock knob fixed on a lock spindle, a drive tumbler driven by the lock spindle, driven tumblers, and an actuator extending into a rear panel mounted rearwardly of the lock, the actuator operable to sever a drive connection between the lock spindle and the drive tumbler such that the lock spindle and lock knob can rotate relative to the drive tumbler for altering a combination of the lock.

22. The changeable combination lock of claim 21 wherein the actuator is a button on a cup engaging the drive tumbler, the button extending rearwardly into the rear panel such that the drive connection is severed when force applied to the button exceeds an opposite force applied to the drive tumbler by a biasing device.

23. The changeable combination lock of claim 22 wherein the cup is seated over a drive cam that rotates conjointly with the lock spindle and the biasing device forces the drive tumbler into engagement with the drive cam to establish the drive connection.

24. The changeable combination lock of claim 23 wherein the drive cam and the drive tumbler carry mutually engaging teeth to enhance the drive connection.

25. The changeable combination lock of claim 24 wherein the teeth are saw teeth.

26. The changeable combination lock of claim 24 wherein the teeth of one of the drive cam and the drive tumbler are pegs and the teeth of the other of the drive cam and drive tumbler are holes adapted to receive the pegs.

27. The changeable combination lock of claim 24 wherein one of the drive cam and the drive tumbler has more teeth than the other of the drive cam and the drive tumbler.

28. The changeable combination lock of claim 27 wherein the number of teeth on the part with the greater number of teeth is a whole number factor of a maximum number in a scale on the lock knob.

29. The changeable combination lock of claim 21 wherein the actuator is a screw extending through an upper drive cam in fixed longitudinal relation thereto and threadedly engaging the lock spindle such that unscrewing the screw severs the drive connection, the screw also extending into the rear panel.

30. The changeable combination lock of claim 29 wherein the upper drive cam rotates conjointly with the lock spindle and selectively engages a lower drive cam that rotates conjointly with the drive tumbler, the engagement between the upper and lower drive cams being controlled by the actuator and selectively establishing the drive connection.

31. The changeable combination lock of claim 30 wherein the upper and lower drive cams carry mutually engaging teeth to enhance the drive connection.

32. The changeable combination lock of claim 31 wherein the teeth are saw teeth.

33. The changeable combination lock of claim 31 wherein the teeth of one drive cam are pegs and the teeth of the other drive cam are holes adapted to receive the pegs.

34. The changeable combination lock of claim 31 wherein one of the drive cams has more teeth than the other drive cam.

35. The changeable combination lock of claim 34 wherein the number of teeth on the drive cam with the greater number of teeth is a whole number factor of a maximum number in a scale on the lock knob.

36. In a changeable combination lock, a method of changing a combination for a combination lock comprising the steps of:

a. aligning gate notches of drive and driven tumblers of the lock;

b. using an actuator extending into a rear panel of a door in which the lock is mounted to operate a clutch mounted between the drive tumbler and a lock spindle and temporarily sever a drive connection between the drive tumbler and the lock spindle;

c. rotating a lock knob carrying a scale by a desired increment; and d. operating the clutch to reestablish the drive connection between the drive tumbler and the lock spindle, thereby altering the point of gate notch alignment of the tumblers by the increment the knob is rotated and changing all numbers in the combination by that increment.

37. The method of claim 36 in which the step of rotating the lock knob by a desired increment is performed in accordance with a relationship between a scale of the lock knob and the drive relationship between the lock spindle and the drive tumbler.

38. The method of claim 36 in which the clutch comprises an upper drive cam rotating with the lock spindle and a lower drive cam rotating with the drive tumbler, and the relationship comprises a number of possible engagement points between the upper and lower drive cams that is a factor of the highest number of the scale.

39. The method of claim 36 in which the clutch comprises a cup mounted on the lock spindle around a drive cam such that the cup can rotate relative to the lock spindle, the actuator is a button on the cup extending into the rear panel, the drive tumbler is biased to engage the drive cam and the cup, and the relationship comprises a number of possible engagement points between the drive cam and the drive tumbler that is a factor of the highest number of the scale.

* * * * *